US006800798B2

(12) United States Patent
Hsieh

(10) Patent No.: US 6,800,798 B2
(45) Date of Patent: Oct. 5, 2004

(54) MUSICAL INSTRUMENT DISPLAY STAND

(76) Inventor: Wu-Hong Hsieh, No. 162, Chung Shan 2nd Rd., Lu Chou City, Taipei Hsien (TW)

( * ) Notice: Subject to any disclaimer, the term of this patent is extended or adjusted under 35 U.S.C. 154(b) by 82 days.

(21) Appl. No.: 10/351,395

(22) Filed: Jan. 27, 2003

(65) Prior Publication Data

US 2004/0144233 A1 Jul. 29, 2004

(51) Int. Cl.[7] ..... G10D 3/00
(52) U.S. Cl. ..... 84/327; 84/421; 84/453
(58) Field of Search ..... 84/327, 421, 453

(56) References Cited

U.S. PATENT DOCUMENTS 2,058,184 A * 10/1936 Sherrard ..... 211/85.6
4,352,480 A * 10/1982 Gathright ..... 248/448
5,149,901 A * 9/1992 Boor et al. ..... 84/327

* cited by examiner

*Primary Examiner*—Shih-yung Hsieh
(74) *Attorney, Agent, or Firm*—Rosenberg, Klein & Lee

(57) ABSTRACT

A musical instrument display stand includes a base rod, connecting assemblies, abutting posts and arm assemblies. The base rod has a top, a left end and right end, and the connecting assemblies are rotatably mounted on the top of the base rod. Each abutting post and arm assembly is respectively and pivotally mounted in each connecting assembly to hold a musical instrument for display and can be folded in the same direction to reduce the volume of the stand to save space for storage. Each connecting assembly can be turned to accommodate a specific angle of displaying and viewing the musical instruments. Consequently, the musical instrument display stand is suitable for display musical instruments and can be conveniently stored.

8 Claims, 10 Drawing Sheets

MUSICAL INSTRUMENT DISPLAY STAND

BACKGROUND OF THE INVENTION

1. Field of the Invention

The present invention relates to a musical instrument display stand, and more particularly to a musical instrument display stand suitable for conveniently displaying and storing a musical instrument.

2. Description of Related Art

Musical instrument display stands are used to position and locate musical instruments for buyers and keep musical instruments from being damaged. With reference to FIG. 9, a kind of musical instrument display stand in accordance with prior art includes a pole (60), holding forks (61), support rods (62) and a tripod (63). The pole (60) is mounted vertically in the tripod (63) that provides the means for the musical instrument display stand to stand on the ground. The holding forks (61) and the support rods (62) are attached to and extend out radially from the pole (60). Each holding fork (61) incorporation with a corresponding support rod (62) can hold one musical instrument. However, this kind of conventional musical instrument display stand is tall, and the musical instrument is positioned in a high position. If musical instruments are not placed symmetrically on the musical instrument display stand, the musical instrument display stand will become unstable and easily fall over.

With reference to FIG. 10, another kind of conventional musical instrument display stand comprises a frame (70), and a stand (72). The frame (70) has a top transverse rod (not numbered) and two; side rods (not numbered). Each side rod has a top end (not numbered) connected to the top transverse rod and a bottom end (not numbered). Abutting stubs (71) are attached to the top transverse rod of the frame (70) equal distances from each other. The bottom ends of the frame (70) are connected to the stand (72). Musical instruments, such as guitars, are positioned on the stand (72) and respectively lean against the corresponding abutting stubs (71). However, such as the musical instrument display stand is too large and occupies a big space-when stored. Also, the musical instruments may slide on the stand (72) and knock against each other. This kind of musical instrument display is also inconvenient to use.

To overcome the shortcomings, the present invention provides a musical instrument display stand to mitigate or obviate the aforementioned problems.

SUMMARY OF THE INVENTION

The main objective of the invention is to provide a musical instrument display stand to display musical instruments, and the musical instrument display stand is adjustable to accommodate for various viewing angles.

Another objective of the invention is to provide a foldable musical instrument display stand that is conveniently stored.

Other objectives, advantages and novel features of the invention will become more apparent from the following detailed description when taken in conjunction with the accompanying drawings.

DETAILED DESCRIPTION OF PREFERRED EMBODIMENT

Figure 1:
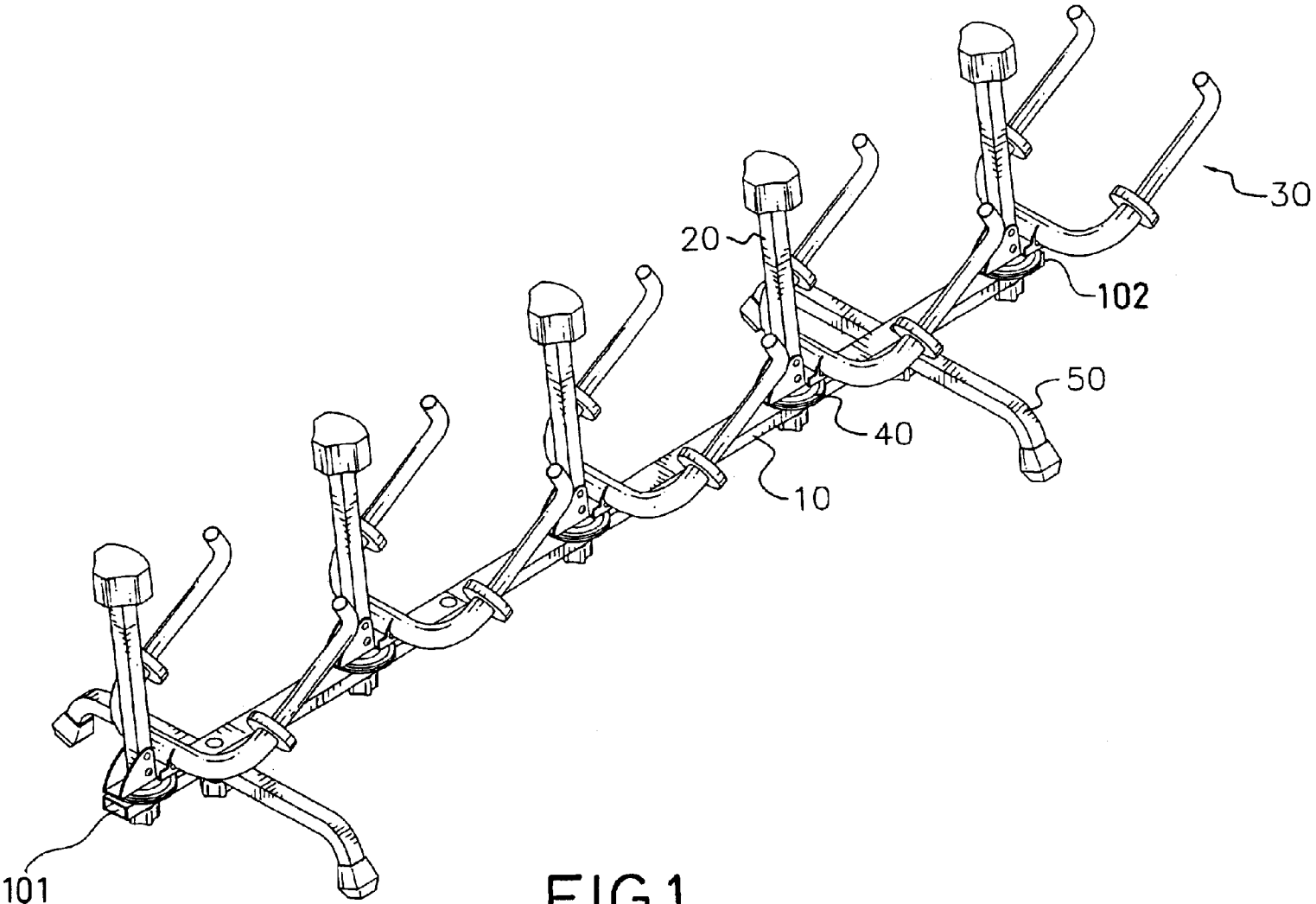
FIG. 1 is a perspective view of a musical instrument display stand in accordance with the present invention.

With reference to FIG. 1, a musical instrument display stand in accordance with the present invention comprises a base rod (10), abutting posts (20), arm assemblies (30), connecting assemblies (40) and legs (50).

Figure 2:
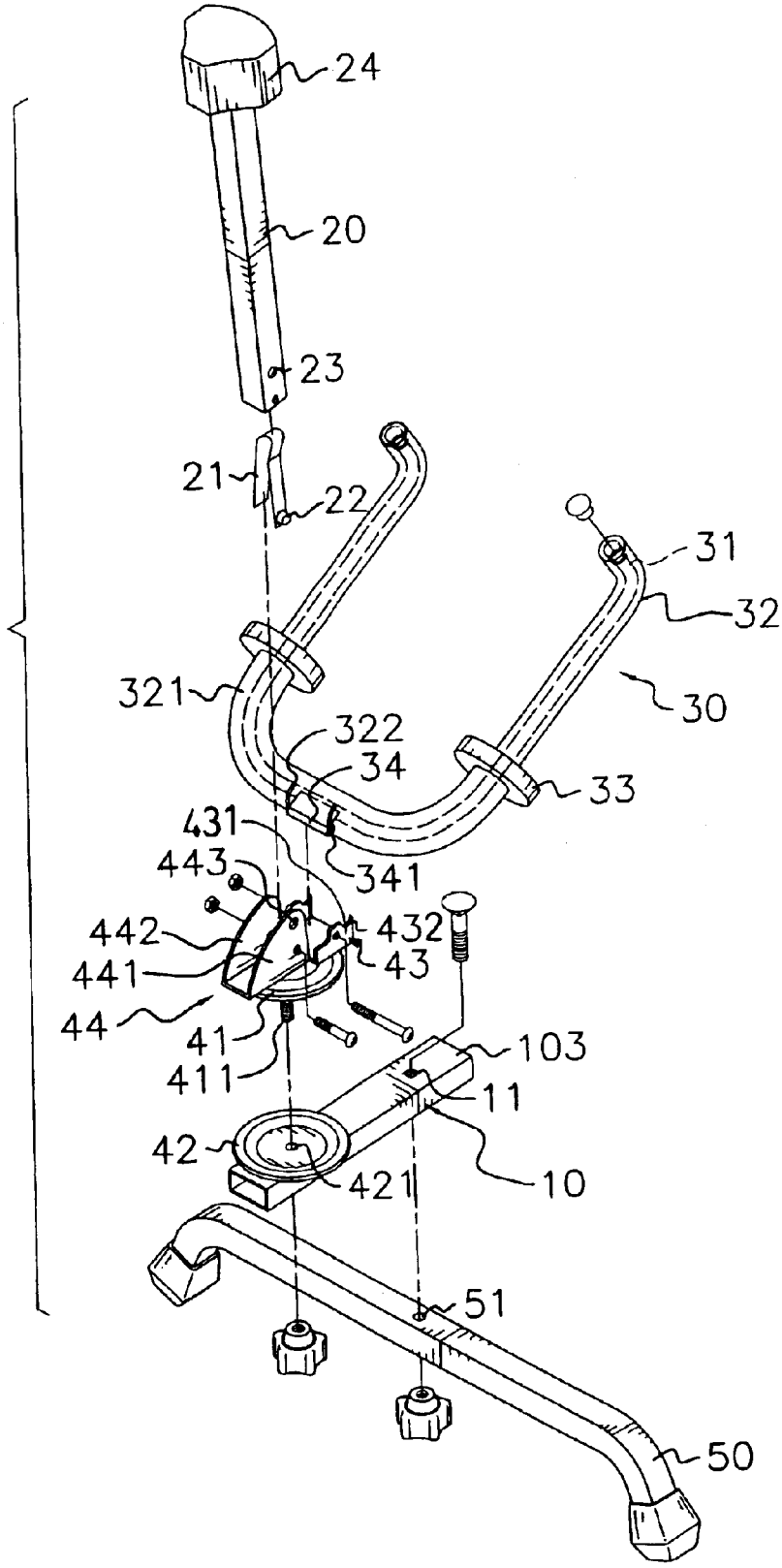
FIG. 2 is an exploded perspective view of one segment of the musical instrument display stand in FIG. 1.
Figure 3:
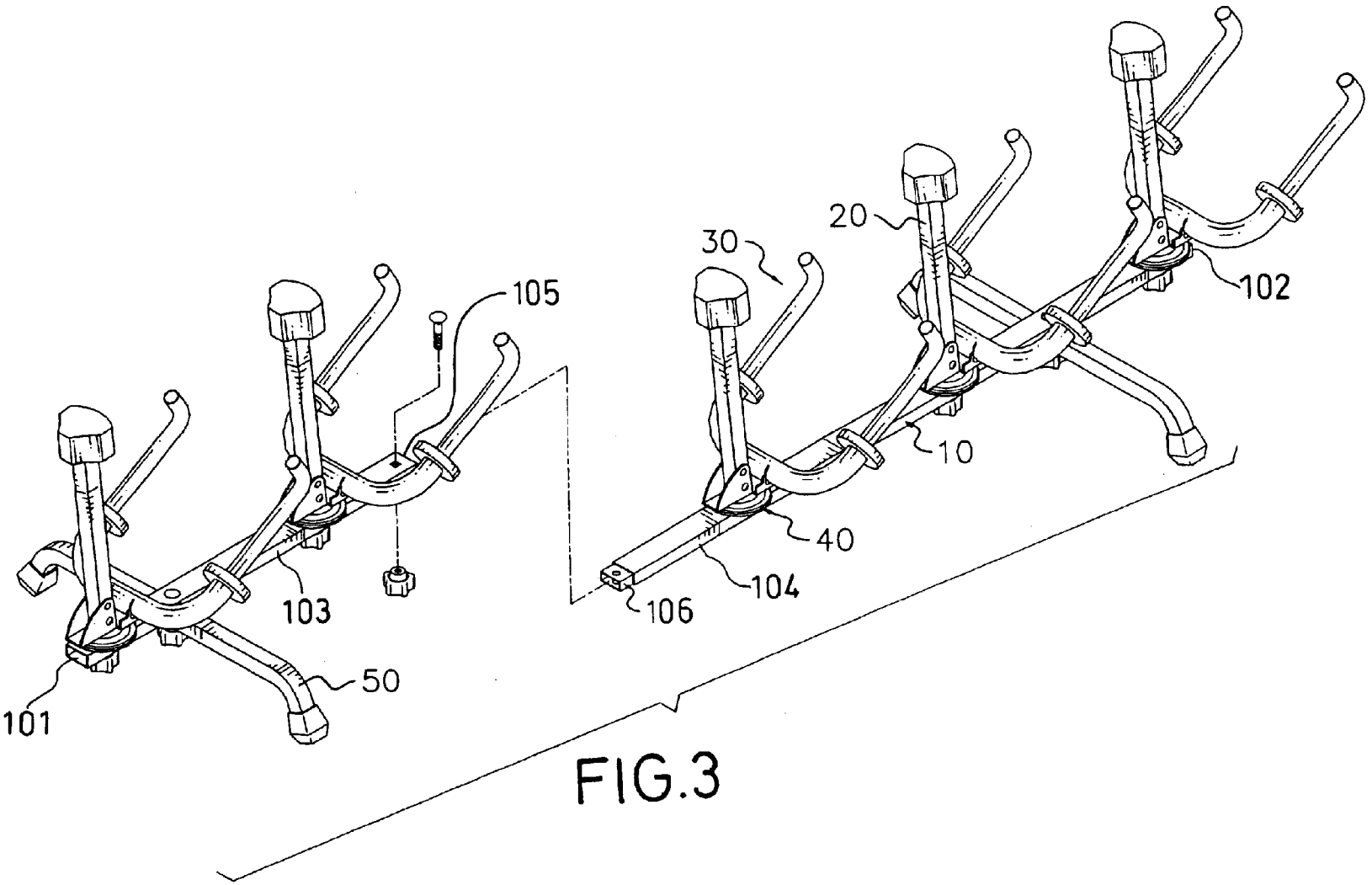
FIG. 3 is a partially exploded perspective view of the musical instrument display stand in FIG. 1.
Figure 4:
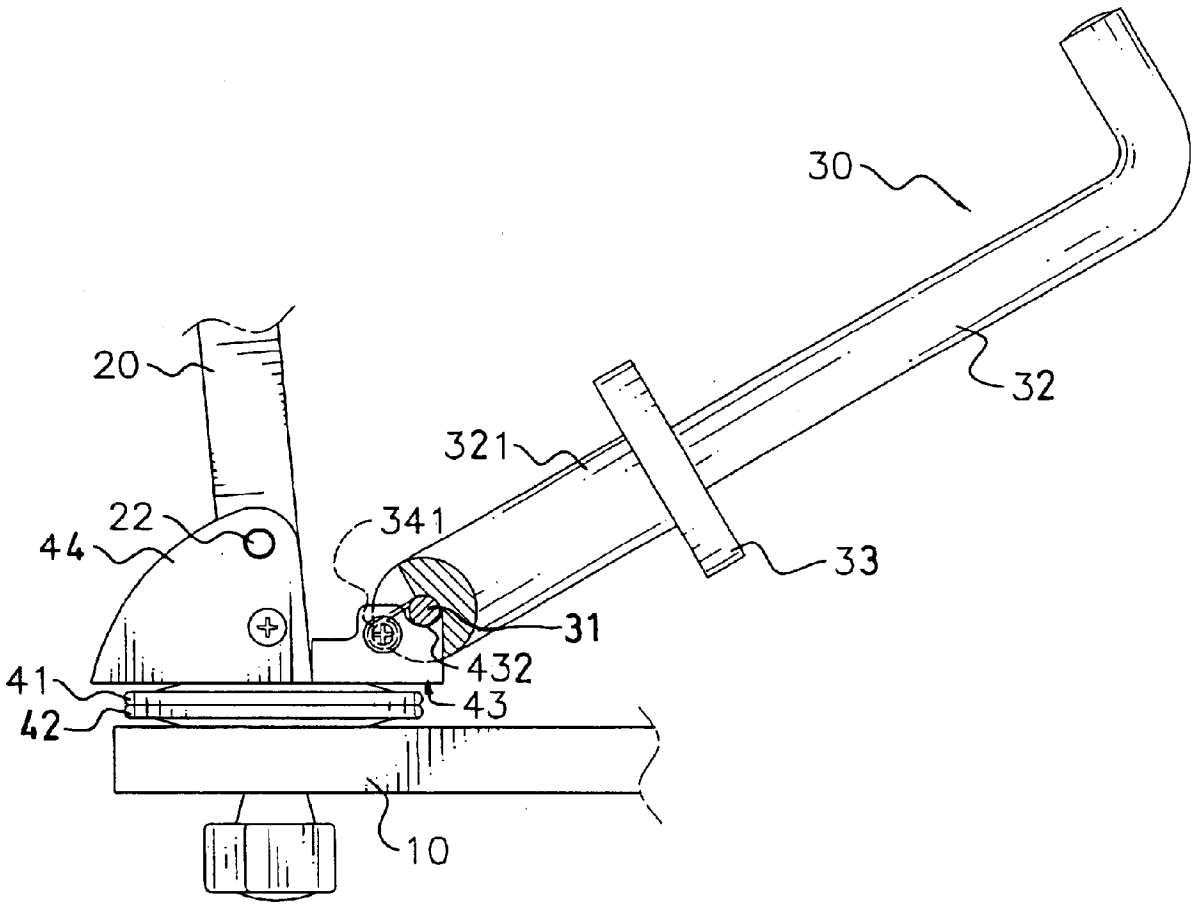
FIG. 4 is a partial plan view in partial section of the musical instrument display stand in FIG. 1.

With further reference to FIGS. 2 to 4, the base rod (10) is a hollow rectangular tube, has a top (not numbered), a bottom (not numbered), a left end (101) and a right end (102). The base rod (10) is detachable and comprises a short body (103) and a long body (104). The short body (103) has a female end (105) opposite to the left end (101) of the base rod (10), and the long body (104) has a male end (106) corresponding to the female end (105) of the short body (103). The male end (106) of the long body (104) is securely attached to the female end (105) of the short body (103) by means of fasteners (not numbered) such as a nut and bolt screwed. Several connecting holes (11) are defined vertically through the top and the bottom of the base rod (10) in sequence from the left end (101) to right end (102) and are used to attach the connecting assemblies (40) and legs (50), respectively.

Each connecting assembly (40) comprises an upper disk (41), a lower disk (42), an arm seat (43) and a post seat (44). A central hole (421) is defined in the lower disk (42), and the lower disk (42) is attached to the top of the base rod (10). The central hole (421) in the lower disk (42) is aligned with one of the connecting holes (11) in the base rod (10). The upper disk (41) has a top (not numbered), a bottom (not numbered) and a center. A fastener (411) with an externally threaded end (not numbered) is attached to and extends from the center of the bottom of the upper disk (41). The arm seat (43) and the post seat (44) are attached to the top of the upper disk (41). The fastener (411), such as a stud, on the bottom of the upper disk (41) passes through the central hole (421) in the lower disk (42) and connecting hole (11) in the base rod (10). The threaded end of the fastener (411) extends out of the connecting hole (11) at the bottom of the base rod (10). A nut (not numbered) is screwed to the threaded fastener (411) to attach the connecting assembly (40) to the top of the base rod (10).

The arm seat (43) that is mounted on the top of the upper disk (41) has two parallel connecting wings (431) defined perpendicular to the top of the upper disk (41). A detent (432) is defined in each connecting wing (431) of the arm seat (43), and the detents (432) are aligned with each other.

The post seat (44) is mounted on the top of the upper disk (41), corresponds to the arm seat (43) and has a first wing (441) and a second wing (442). The first wing (441) and the second wing (442) of the post seat (44) are parallel to the connecting wings (431) of the arm seat (43) and perpendicular to the top of the upper disk (41) and have a top edge. A locking hole (443) is transversally defined in the first wing (441) near the top edge of the first wing (441).

The abutting post (20) is hollow, has a top end (not numbered) and a bottom end (not numbered) and is adapted to abut a musical instrument (not shown), such as a guitar. A guide hole (23) is defined in the abutting post (20) near the bottom end corresponds to the locking hole (443) in the first wing (441). A U-shaped resilient member (21) with a locking stub (22) is inserted inversely into the bottom end of the abutting post (20). The locking stub (22) extends out of the guide hole (23) in the abutting post (20). The bottom end of the abutting post (20) is pivotally mounted between the first and the second wings (441, 442) in the post seat (44). The guide hole (23) is aligned with the locking hole (443) in the first wing (441) of the post seat (44) so the locking stub (22) on the elastic member (21) engages the locking hole (443) in the first wing (441) to hold the abutting post.(20) vertical in the post seat (44). A bumper (24) made of soft or elastic material is attached to the top end of the abutting post (20) and abuts the musical instrument.

An arm assembly (30) is pivotally attached to each arm seat (43) of the connecting assembly (40) and is adapted to cooperate with the abutting post (20) to hold the musical instrument in position on the musical instrument display stand. The arm assembly (30) includes an arm (31), a stepped protective cover (32), two adjustment rings (33) and a connector (34). The arm (31) is U-shaped, has two free ends (not numbered) and a cross member (not numbered) with a center opposite from the free ends. The free ends of the arm (31) are bent toward the abutting post (20). The stepped protective cover (32) is made of soft material and is mounted around the arm (31) to prevent the musical instrument from being damaged. An enlarged segment (321) is formed in the stepped protective cover (32) on the cross member of the arm (31). The connector (34) has a transverse hole (341), is attached to the center of the cross member of the arm (30) and is used to pivotally connect the arm (30) to the two connecting wings (431) of the arm seat (43). A slot (322) is defined in the enlarged segment (321) of the stepped protective cover (32) and corresponds to each connecting wing (431) of the arm seat (43). Each connecting wing (431) is received in the corresponding slot (322) in the enlarged segment (321). The cross member of the arm (31) is held in the detents (432) in the connecting wings (431) of the arm seat (43) such that the cross member of the arm (31) is supported by the connecting wings (431). Therefore, the arm (31) could be positioned on the arm seat (43) at an angle with respect to the base rod (10).

The legs (50) are rotatably attached to the bottom of the base rod (10) respectively near the left end (101) and the right end (102) of the base rod (10) to provide means for the musical instrument display stand to stand on the ground.

Figure 5:
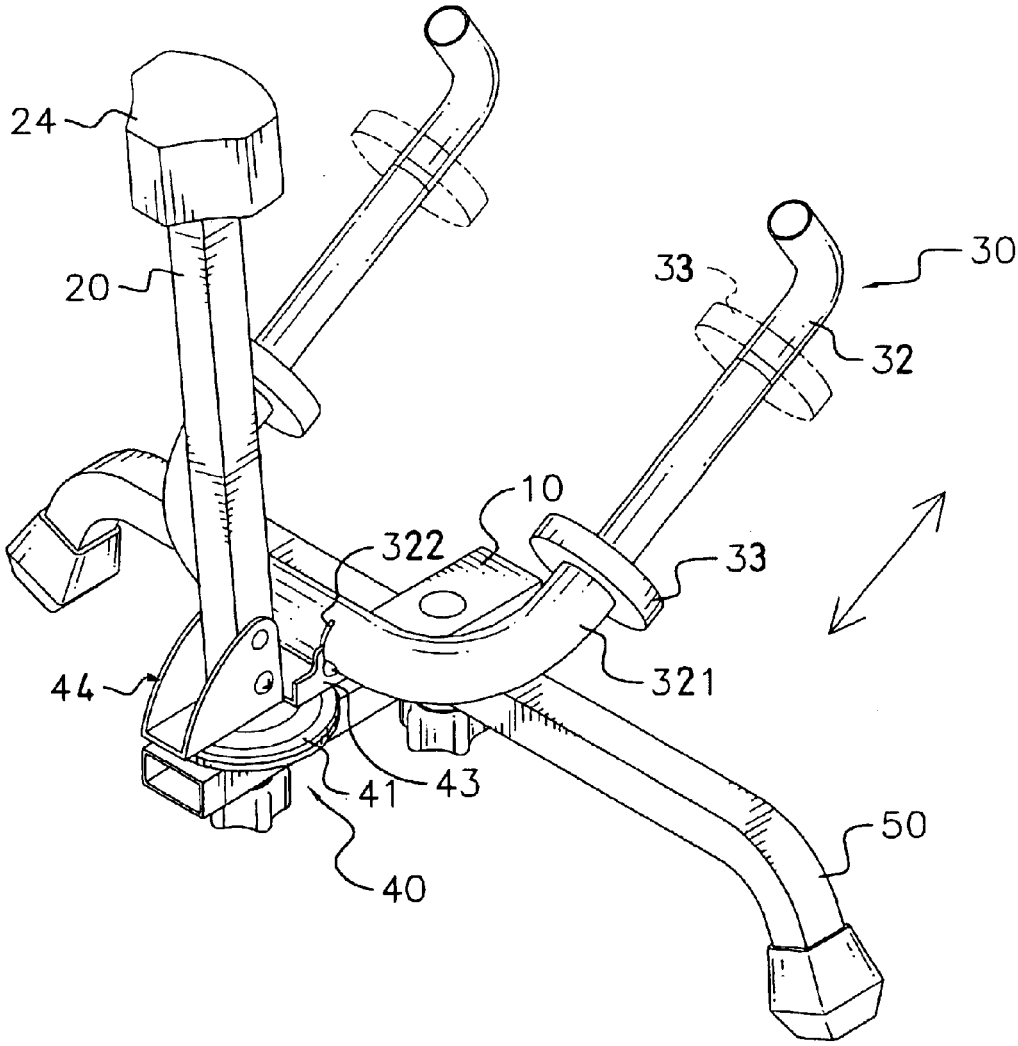
FIG. 5 is an operational perspective view of a part of the musical instrument display stand in FIG. 1 showing an adjustment, ring in different positions.

With reference to FIG. 5, each adjustment ring (33) is slidably mounted on the stepped protective cover (32) between the free end of the arm (31) and the enlarged segment(321). The adjustment ring (33) can be moved to a suitable or adequate position to accommodate musical instruments of various thicknesses.

Figure 6:
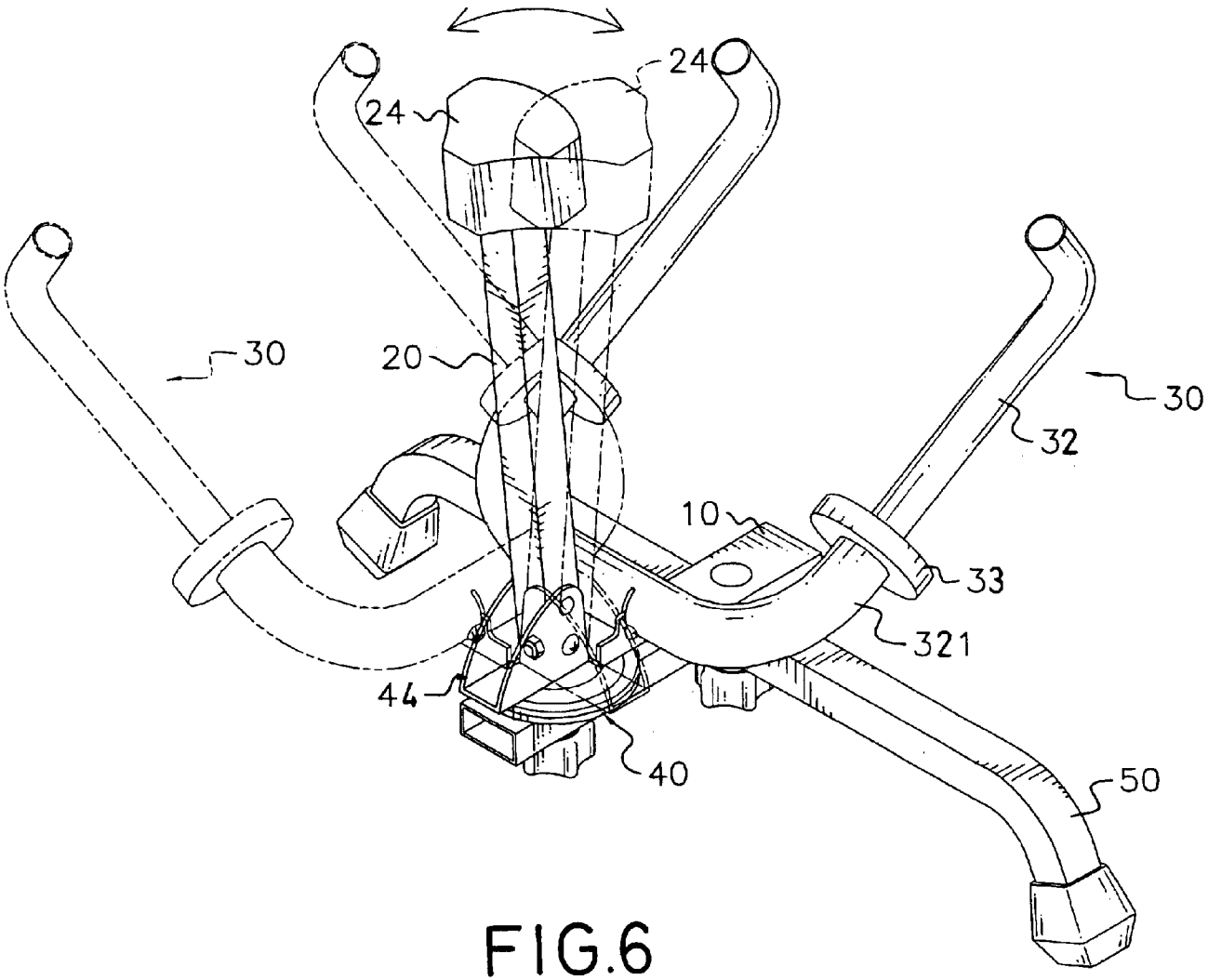
FIG. 6 is an operational perspective view of a part of the musical instrument display stand in FIG. 1 showing the display stand adjusted for various viewing angles.

With reference to FIG. 6, the musical instrument display stand is suitable for displaying the musical instrument because the connecting assembly (40) can easily be turned to a perfect viewing angle. A user only needs to loosen the nut, rotates the connecting assembly (40) to the angle and tightens the nut. The operation is very convenient and does not require any tools.

Figure 7:
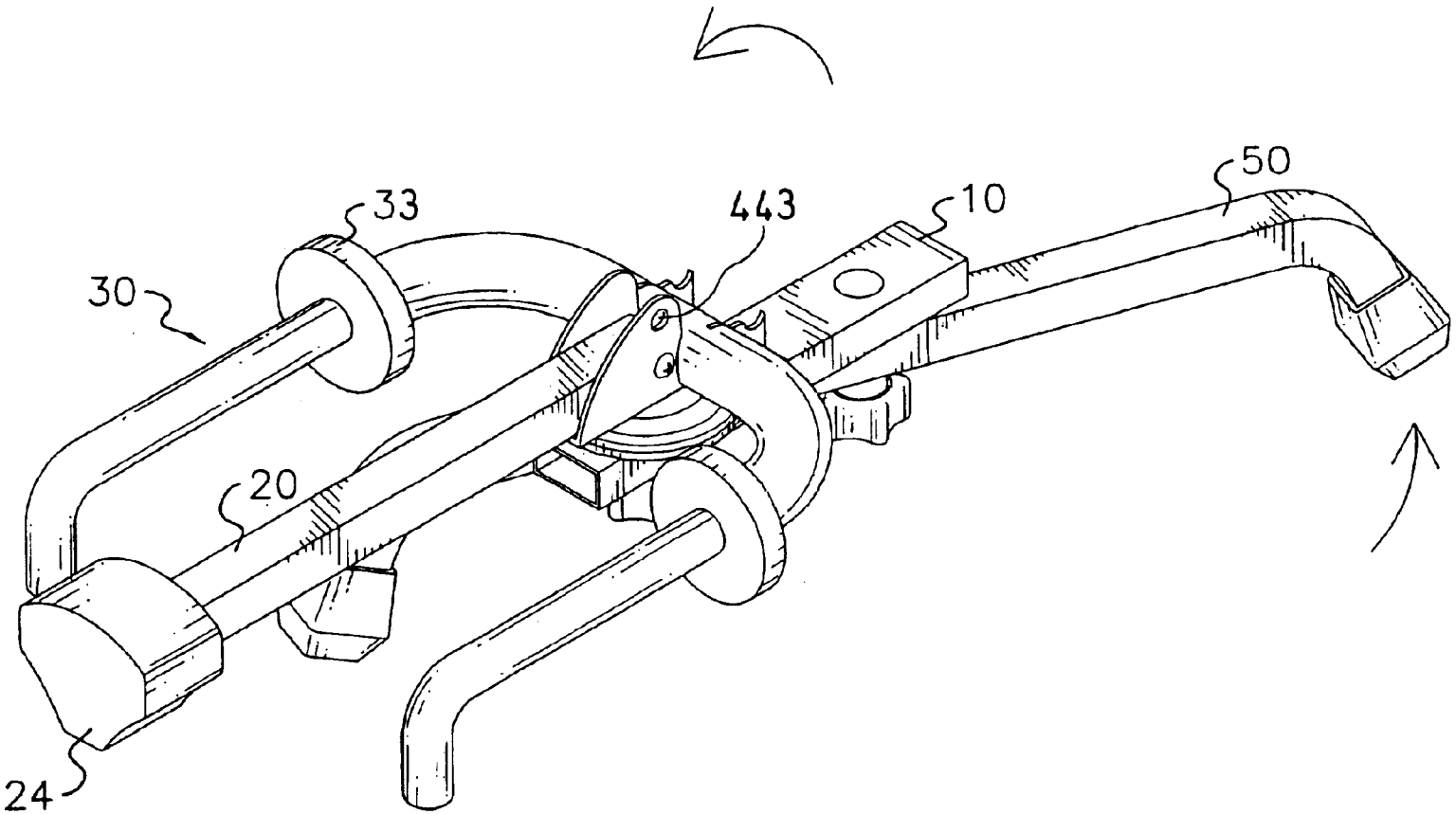
FIG. 7 is an operational perspective view of a part of the musical instrument display stand in FIG. 1 folded for storage.

With reference to FIG. 7, the musical instrument display stand can be folded easily to store the musical instrument display stand and saves storage space. The user first disconnects the short body (103) and the long body (104) of the base rod (10) and turns the legs (50) to align respectively with the short body (103) and the long body (104). By pressing the locking stub (22) inward, the abutting post (20) is disengaged from the locking hole (443) in the first wing (441), and the abutting post (20) is easily folded. Similar, the arm assembly (30) is raised and folded down toward the abutting post (20). Consequently, all of the legs (50), the abutting posts (20), the arm assemblies (30) are nearly aligned with the short body (103) and the long body (104) to reduce the volume of the musical instrument display to save space for storage.

Figure 8:
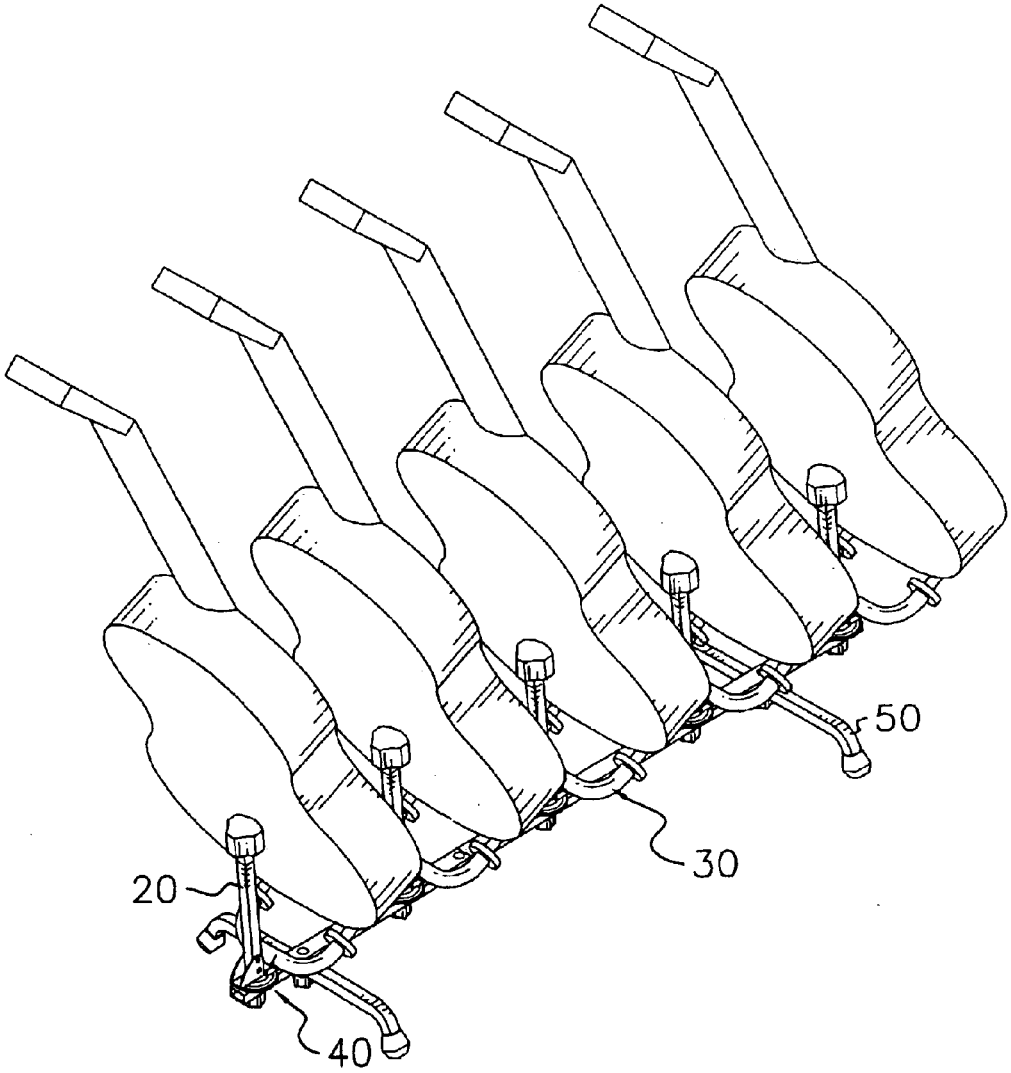
FIG. 8 is an operational perspective view of the musical instrument display stand in FIG. 1 used to display guitars.
Figure 9:
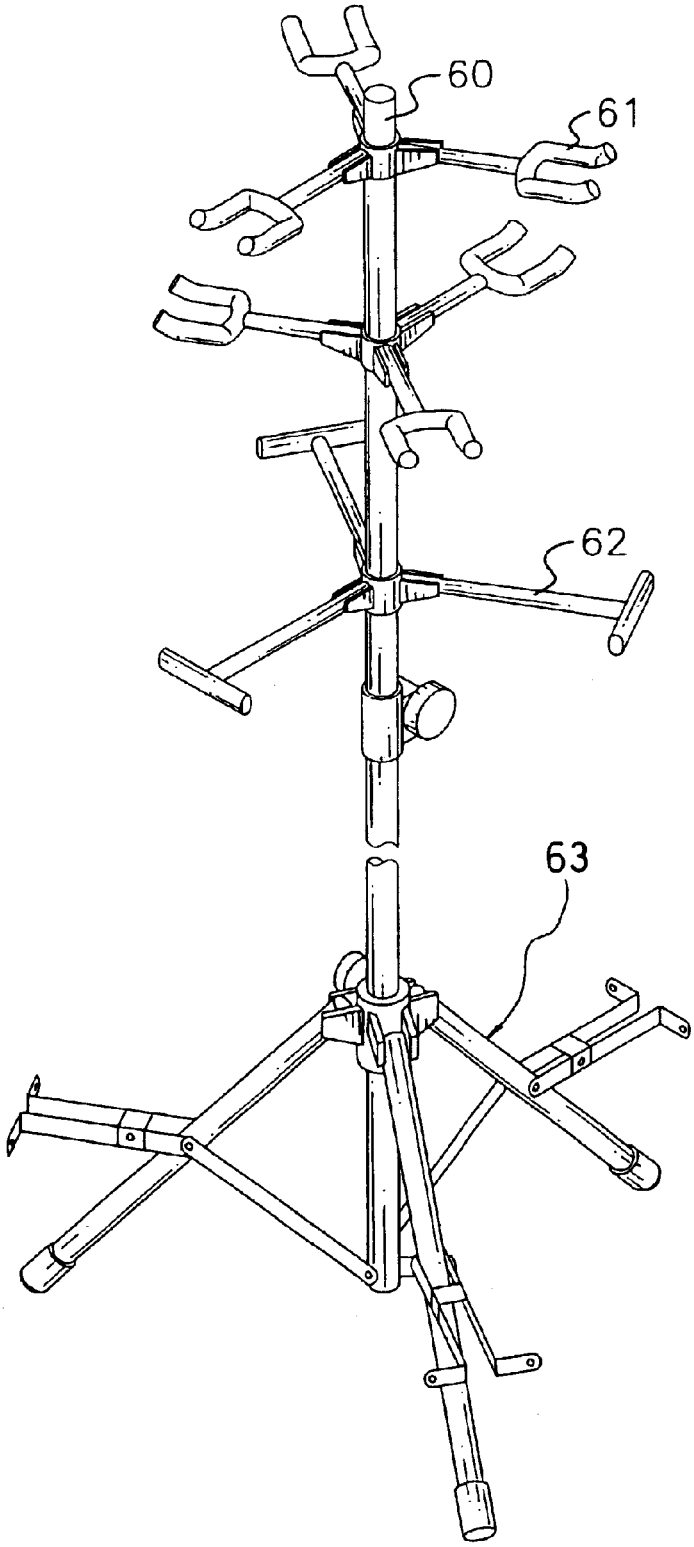
FIG.9 PRIOR ART
FIG. 9 is a perspective view of a conventional musical instrument display stand in accordance with the prior art.
Figure 10:
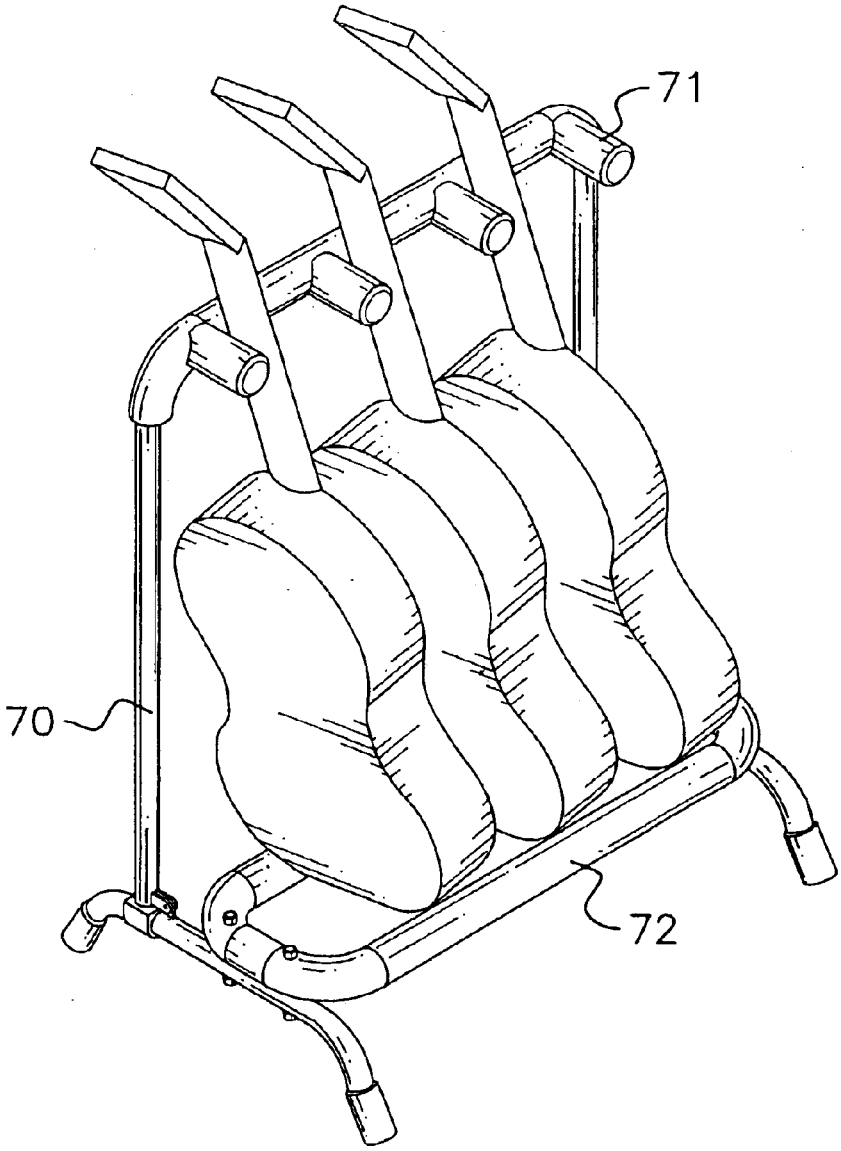
FIG.10 PRIOR ART
FIG. 10 is a perspective view of another conventional musical instrument display stand in accordance with the prior art.

With reference to FIG. 8, the musical instrument display stand can be used to display guitars (not numbered). The musical display stand is not only convenient to use but saves storage space. Furthermore, the musical instrument display stand precisely holds each musical instrument so they do not bump against each other. Musical instruments held on the musical instrument display can be easily turned to the perfect viewing angle for display. Consequently, the musical instrument display stand is suitable for displaying musical instruments and will save more space when the musical instrument display stand is not in use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A musical instrument display stand comprising:

a base rod having a top, a bottom, a left end, a right end and multiple connecting holes defined through the top to the bottom in sequence from the left end to the right end;

multiple connecting assemblies rotatably attached to the top of the base rod, and each connecting assembly comprising an upper disk with a top and a bottom rotatably mounted on the top of the base rod by means of a fastener being rotatably mounted in one of the connecting holes;

an arm seat mounted on the top of the upper disk and the arm seat having two connecting wings defined parallel to each other and perpendicular to the top of the upper disk; and a detent defined in each connecting wing of the arm seat on the upper disk; and a post seat mounted on the top of the upper disk corresponding to the arm seat and the post seat having a first wing with a top edge formed perpendicular to the top of the upper disk;

a second wing formed perpendicular to the top of the upper disk, both the first wing and the second wing of the post seat parallel to the connecting wings of the arm seat; and a locking hole transversely defined in the first wing near the top edge;

at least two legs respectively attached to the bottom of the base rod and adapted to stand the base rod;

an abutting post pivotally mounted in the post seat of each connecting assembly and having a guide hole, a top end and a bottom end, the bottom end of the abutting post pivotally mounted in the post seat of each connecting assembly, and the guide hole defined near the bottom end aligned with the locking hole in the first wing of the post seat of each connecting assembly, and a locking stub retractably mounted in and extending out of the guide hole in the abutting post to engage the locking hole in the first wing of the post seat of each connecting assembly; and an arm assembly pivotally mounted in the arm seat of each connecting assembly and comprising a U-shaped arm with two free ends and a cross member with a center formed opposite from the two free ends, and the cross member of the arm pivotally mounted in the arm seat of each connecting assembly and held in the detent of the connecting wings of the arm seat of each connecting assembly.

2. The musical instrument display stand as claimed in claim 1, wherein the abutting post is hollow; and the musical instrument display stand further comprises a U-shaped resilient member inversely inserted into the bottom end of the abutting post, and the locking stub is attached to the U-shaped resilient member.

3. The musical instrument display stand as claimed in claim 2, wherein each arm assembly further comprises a stepped protective cover made of soft material mounted around the U-shaped arm and the stepped protective cover having an enlarged segment formed in the stepped protective cover at the cross member of the arm;

two slots respectively defined in the enlarged segment corresponding to the connecting wings of the arm seat for respectively receiving the connecting wings;

an adjustment ring slidably mounted on the stepped protective cover between each free end of the arm and the enlarged segment of the protective cover; and a connector attached to the center of the cross member of the arm and pivotally mounted in the arm seat between the connecting wings.

4. The musical instrument display stand as claimed in claim 3, wherein each connecting assembly further comprises a lower disk with a central hole defined through and mounted between the upper disk and the top of the base rod, and the central hole of the lower disk aligned with a corresponding one of the multiple connecting holes; and the fastener has an external threaded end is centrally attached to the bottom of the upper disk, and the external threaded end of the fastener passes through the aligned central hole and the connecting hole and extends out of the connecting hole at the bottom of the base rod to be screwed with a nut.

5. The musical instrument display stand as claimed in claim 4, wherein a bumper made of elastic materials is attached to the top end of the abutting post and is adapted to abut against the musical instrument.

6. The musical instrument display stand as claimed in claim 5, wherein the base rod is detachable and comprises a short body with a female end and a long body with a male end, and the male end of the long body is securely attached to the female end of the short body by means of a fastener.

7. The musical instrument display stand as claimed in claim 3, wherein a bumper made of elastic materials is attached to the top end of the abutting post and is adapted to abut against the musical instrument.

8. The musical instrument display stand as claimed in claim 7, wherein the base rod is detachable and comprises a short body with a female end and a long body with a male end, and the male end of the long body is securely attached to the female end of the short body by means of a fastener.

* * * * *